United States Patent [19]

Korenberg

[11] Patent Number: 4,879,959

[45] Date of Patent: Nov. 14, 1989

[54] SWIRL COMBUSTION APPARATUS

[75] Inventor: Jacob Korenberg, York, Pa.

[73] Assignee: Donlee Technologies, Inc., York, Pa.

[21] Appl. No.: 118,933

[22] Filed: Nov. 10, 1987

[51] Int. Cl.[4] ..... F23D 1/02

[52] U.S. Cl. ..... 110/264; 140/265; 431/157

[58] Field of Search ..... 110/260–265, 110/234; 122/15, 22, 273, 327, 331, 332, 343, 344, 346, 350, 469, 473; 431/157, 173, 182, 183

[56] References Cited

U.S. PATENT DOCUMENTS

| | | | |
|---|---|---|---|
| 1,535,886 | 4/1925 | Zulver . | |
| 1,679,830 | 8/1928 | Lang . | |
| 2,395,103 | 2/1946 | Clausen et al. | 110/260 X |
| 2,465,675 | 3/1949 | DeLancey | 431/265 |
| 2,499,207 | 2/1950 | Wolfersperger | 431/158 |
| 2,556,804 | 6/1951 | Fagan | 110/260 X |
| 2,807,243 | 9/1957 | Rehm | 122/473 |
| 2,985,438 | 5/1961 | Prowler | 431/157 |
| 3,173,499 | 3/1965 | Ross | 431/158 |
| 3,273,621 | 9/1966 | Childree | 431/284 X |
| 3,376,098 | 4/1968 | Pryor | 431/10 |
| 3,805,714 | 4/1974 | Sharpe | 110/261 |
| 3,969,443 | 11/1976 | Campbell | 110/263 X |
| 3,998,581 | 12/1976 | Hemingway | 431/158 |
| 4,003,692 | 1/1977 | Moore | 431/158 |
| 4,147,116 | 4/1979 | Graybill | 110/264 X |
| 4,154,567 | 5/1979 | Dahmen | 431/5 |
| 4,240,784 | 12/1980 | Dauvergne | 431/351 |
| 4,245,980 | 1/1981 | Reed et al. | 431/351 X |
| 4,260,367 | 4/1981 | Markowski | 431/353 |
| 4,457,289 | 7/1989 | Korenberg | 122/4 D |
| 4,565,137 | 1/1986 | Wright | 110/265 X |
| 4,574,711 | 3/1986 | Chrishan | 110/264 |
| 4,627,366 | 12/1986 | LeRue et al. | 110/264 X |

OTHER PUBLICATIONS

Hazardous Waste Disposal by Thermal Oxidation, John Zink Company, Tulsa, Oklahoma (undated).

Combustion in Swirling Flow: A Review, N. Syred and J. M. Beer, Combustion Flame, vol. 23, pp. 143–210 (1974).

*Primary Examiner*—Henry C. Yuen

*Attorney, Agent, or Firm*—Finnegan, Henderson, Farabow, Garrett & Dunner

[57] ABSTRACT

A swirl combustion apparatus includes a combustion chamber with a substantially cylindrical wall. A peripheral swirl of air is supplied into the combustion chamber adjacent said inner surface of the cylindrical wall. Partially preburned fuel is supplied from a precombustion chamber to the combustion chamber to mix with the swirl of air, burn in said combustion chamber and form hot combustion gases. The combustion chamber has a rear end well with an annular combustion chamber outlet concentrically aligned with the combustion chamber and defined by an outer cylindrical outlet wall and an inner cylindrical outlet wall. The annular combustion chamber outlet has slots for directing hot combustion gases through said annular combustion chamber outlet in a direction substantially tangential to said inner surface of said combustion chamber wall.

27 Claims, 9 Drawing Sheets

FIG. 62
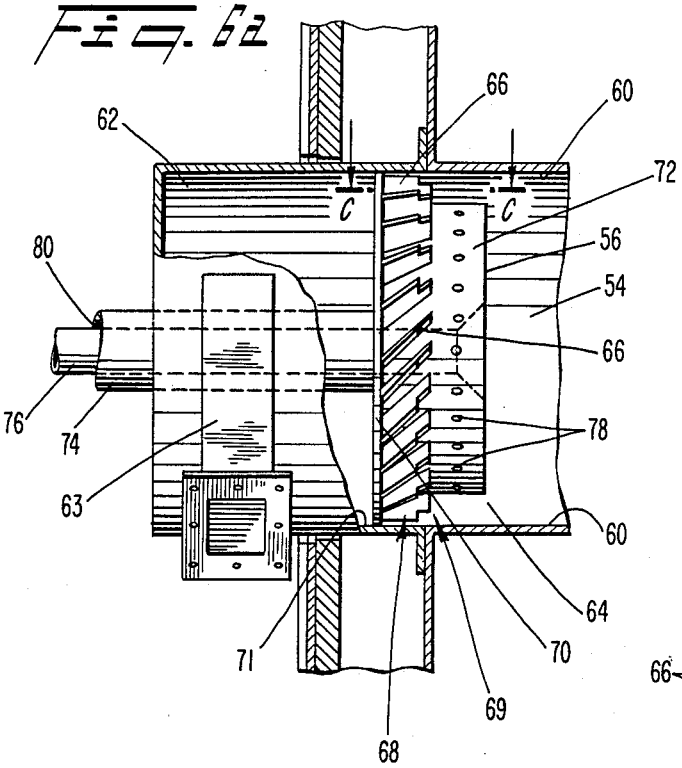
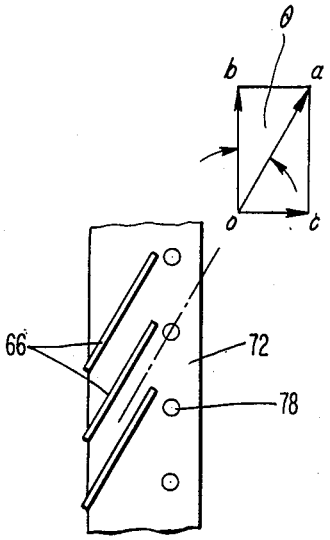
FIG. 60
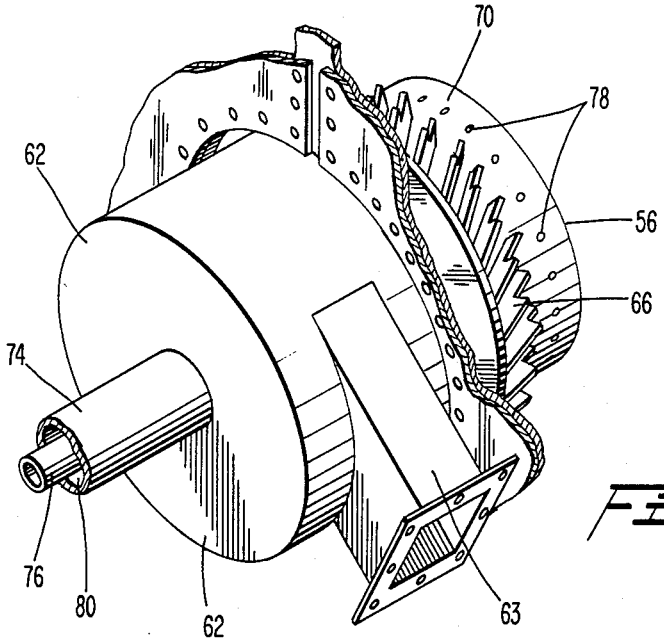
FIG. 63

OIL IN
NATURAL GAS IN
JET AIR
PRIMARY AIR
COMBUSTION GASES
θ
101
102
96
96a
98
45
52
60
100
C
81
82
83
84
86
87
88
89
90
93
94
75

SWIRL COMBUSTION APPARATUS

BACKGROUND OF THE INVENTION

The present invention relates to swirl combustion, and more particularly to a combustion apparatus and related method that provides high combustion intensity and efficient heat transfer to combustion chamber walls, while producing exhaust gases with a low concentration of nitrogen oxide, commonly known as $NO_x$.

Swirling flows have been used in combustion chambers to improve flame stability and combustion by generating toroidal recirculation zones within a combustion chamber, and by reducing combustion time by producing rapid mixing of fuel and air within the chamber, particularly at the boundaries of the recirculation zones. Two important types of swirling combustors are swirl burners and cyclone combustion chambers.

Cyclone combustion chambers have been used to produce a cyclone of turbulent gases within a combustion chamber for combusting various solid materials, including poor quality coal and vegetable refuse. Such combustors are disclosed in "Combustion in Swirling Flows: A Review", N. Syred and J. M. Beer, Combustion and Flame, Vol. 23, pp. 143–201 (1974); in U.S. Pat. Nos. 4,457,289, and 044,735 filed May 1, 1987 to Korenberg, all of which are incorporated herein by reference.

Although known adiabatic cyclone combustors provide high specific heat release, such known combustors have the disadvantage that combustion temperature is high and $NO_x$ emissions are high. In conventional cyclone combustors, combustion is unstable at low capacity burning and high turndown ratios are not possible in non-adiabatic combustors.

The turndown ratio of a combustion apparatus in a boiler is defined as the ratio of maximum load to minimum load; and measures the ability of the boiler to operate over the extremes of its load ranges. A high turndown ratio allows for a wide range in the level of steam energy generation at a particular time. A wide range of steam energy generation is important to allow the boiler to most efficiently respond to varying steam energy demands. As a result, it is desirable that improvements in swirling efficiency and heat transfer in the boiler combustion chamber and combustion chamber outlet not decrease the turndown ratio of the boiler.

Stable combustion can be achieved by not cooling the walls of a cyclone combustion chamber in the portion of the chamber into which air and fuel are injected for combustion, as is disclosed in U.S. patent application Ser. No. 928,096, filed Nov. 7, 1986 to Korenberg et al. which is incorporated herein by reference. High wall temperatures near the chamber's fuel and air entrance enable a high turndown ratio to be achieved. For example, by incorporating uncooled refractory lined walls at the air and fuel entrance to the combustion chamber, the turndown ratio of maximum to minimum load can be increased from 4:1 up to and higher than 10:1. With such an arrangement, excess air over that required as a combustion reactant, can be decreased from 25–30% to about 5% and kept constant at about 5% over the turndown ratio of 10:1. In addition, the flame temperature can be decreased from about 3000° F. to about 2000° F. for conventional fire tube boilers. By lowering the excess air and by lowering the flame temperature, $NO_x$ emission concentrations are lowered in the flue exhaust.

With pollution control requirements becoming constantly more stringent, it is necessary to decrease $NO_x$ emissions even further than is achieved with the combustion apparatus described above, without increasing the cost of the combustion equipment.

In the prior art cyclone combustion chamber shown in FIG. 1, as it is described in the previously identified publication by Syred & Beer, air and fuel are injected tangentially through an air inlet 16 into a large cylindrical combustion chamber 17 in which the air is combined with burning fuel. Hot combustion gases circulate and recirculate in combustion chamber 17, and then exhaust through a centrally located exit throat 18 in one end of combustion chamber 17. Combustion occurs primarily inside the cyclone chamber, and is aided by large internal reverse flow zones represented generally by the direction of the arrows within chamber 17, which provide a long residence time for the fuel/air mixture. In contrast to a swirl burner, which usually has one central toroidal circulation zone, the cyclonic combustor often has up to 3 concentric toroidal recirculation zones. The long residence time and large number of reverse flow zones result in a high specific heat release from combustion in the chamber.

A summary of the general aerodynamics of such cyclones can be seen in FIG. 1. Five characteristics annular zones are distinguishable. There are two main downward flows, rotating coaxially, which carry the main mass of gas, namely the wall flow represented by arrows 22, and axial flow in the central area represented by arrows 24. In these flows, the maxima of tangential velocity W and axial velocity U are combined. Flows 22 and 24 are divided by a peripheral intermediate zone, occupied by the rising turbulent vortices branching from flows 22 and 24, and forming as a result the reverse stream 26. In zone 28, the profiles of W are dip, U is reversed, and hence the tangential and axial velocity profiles are saddle-like in form, varying over the cyclone height. In central zone represented by arrows 30, two slightly twisted axial flows move opposite to each other, a direct flow from the top, and a reverse flow from the exits as shown by the direction of the arrows.

A large portion of the gas, without reaching the cyclone exit, develops an axial velocity and leaves the top, forming flow 24. However, some of the gas in this top boundary layer is carried over to the cyclone exit and forms the weak descending flow represented by arrows 30. This flow rapidly decays toward zero within one chamber diameter.

It is worth noting that the maximum intensity of turbulence occurs at and around the peak of tangential velocity in region 24. The intensity of turbulence is approximately 5 times lower near the outer wall 20. If the exit throat is removed (the cyclone chamber within wall 20 is then similar to the swirl generator shown in FIG. 2), the root mean square values of the velocity fluctuations ($U'^2$ and $W'^2$) are 1.5 times higher near the walls, and in the main flow (region 203) 3 to 5 times lower than in the cyclone chamber which has a throat.

It is interesting to compare the efficiency of swirl generation in the cyclone combustor and swirl combustor. With the swirl burners, the efficiency of swirl generation is based upon the swirl generated at the exit throat. Usually, as most of the volume recirculation zone, high levels of turbulence and hence mixing occur past the exit throat, it must be expected that increasing the level of efficiency (for a given swirl number), will increase the recirculating mass flow, level of turbulence, and mixing rate. As internal reverse flows are only infrequently formed, little dissipation of swirl energy occurs inside a swirl burner and hence, efficiencies of swirl generation as high as 70–80% can be obtained.

Different criteria apply to cyclone combustion chambers. It has been shown that efficiencies of swirl generation in cyclone combustion chambers are typically 8–15%. This figure was obtained by integration of measured tangential velocity profiles inside the cyclone chamber and comparison with the input energy, and hence include energy dissipation due to the formation of internal reverse flows and high levels of turbulence inside the cyclone chamber.

It can well be argued for cyclone combustion chambers that as long as input losses are minimized, a low to intermediate value of efficiency is beneficial as the energy balance has then been altered toward the production of large internal reverse flows and high levels of turbulent mixing.

Thus, turbulence and recirculation in cyclone combustion chambers have the effect of reducing swirling efficiency of the chamber because of the large amount of turbulence within the chamber, especially in the area of the exit throat. Further, in cyclone combustion chambers, the velocity of air flow along the wall of the combustion chamber is significantly decreased by turbulence and recirculation, especially near the end of the chamber where the exit throat is located. With decreased tangential velocities near the chamber wall, heat transfer to the chamber wall is reduced so that the chamber, if cooled, is not cooled as effectively as would be possible if air velocities were greater near the combustion chamber wall. Reduced cooling efficiency results in higher emissions of NOx for a chamber of the same volume due to the higher combustion temperature.

In a swirl burner, the swirling flow exhausts into a furnace or cavity and combustion occurs in and just outside the burner exit. Two principal modes of swirl generators are in common use: (a) guide vanes in axial tubes and (b) tangential entry of the fluid stream, or part of it, into a cylindrical duct. Despite the differences in configuration, there are many similarities in the flow patterns produced by different types of swirl generators.

A swirl number is a measure of the angular momentum of a swirling fluid in comparison to the linear momentum of the fluid. A higher swirl number is indicative of greater angular momentum and swirling. Swirl numbers of typical swirl burners are usually in the range of 0.6 to 2.5. A large toroidal recirculation zone is formed in the exit, occupying up to 75% of the exit diameter, with up to 80% of the initial flow being recirculated, the swirl number being 2.2. The tangential velocity distribution is of Rankine form (i.e., free/forced vortex) inside the swirler, decaying into a forced vortex distribution at the exit plane.

It is interesting to note that generally for swirl numbers less than 2.4, confinement increases the central recirculated mass flow, while swirl numbers greater than about 1.6 the outer region of circulation disappears. This occurs because, upon leaving the swirl generator, the swirling flow sticks immediately to the walls of the confinement while further downstream, complex recirculation patterns similar to those of cyclone combustion chambers develop.

In a swirl burner, as shown in FIG. 2, a swirling flow of air is tangentially introduced by an air inlet 32 into an air plenum 34 surrounding a swirl chamber 36 into which fuel is axially introduced by fuel inlet 38. Solid end plates 40 seal the ends of air plenum 34 so air injected into air plenum 34 is forced through slits 42 in the wall of swirl chamber 36. Combustion takes place primarily just outside a burner exit 44 with some combustion also occurring within the burner swirl chamber 36.

In swirl burners, large toroidal recirculation zones are generally formed in exit 44 and occupy up to 75 percent of the exit diameter with up to 80 percent of the initial flow being recirculated. Swirl numbers for swirl burners are usually in the range of 0.6–2.5.

As noted above, because swirl burners have an open unrestricted outlet, little dissipation of swirl energy occurs inside the burner and hence, high swirling efficiencies of 70–80% can be obtained, as compared to typical swirling efficiencies of 8–15% for cyclone combustion chambers. However, turbulence in the swirl burner outlet and downstream of the outlet results in dissipation of swirl energy and reduced swirling in the burner outlet and downstream of the outlet. Lower tangential velocities of combustion gases in the outlet and downstream of the outlet, where much of the combustion takes place, makes transfer of combustion heat less efficient. Inefficient heat transfer increases combustion temperatures which results in increased exhaust concentrations of pollutants such as $NO_x$.

SUMMARY OF THE INVENTION

An object of the present invention is to create a fuel burning device that incorporates advantages of both swirl burners and cyclone combustion chambers.

It is also an object of the present invention to provide a fuel burning device having low cost, high combustion intensity and stability, higher heat transfer rate to water cooled walls of the combustion chamber, low excess air, low pollution, and a high turndown ratio.

It is an additional object of the invention to provide a swirl combustion apparatus having a high specific heat release and a high swirling efficiency.

It is also an object of the present invention to provide a swirl combustion apparatus having a chamber in which air and fuel mix efficiently.

A further object of the invention is to provide a swirl combustion apparatus in which swirling air flows along combustion chamber walls at a high rate for efficient heat transfer to the chamber walls.

Another object of the invention is to provide a swirl combustion apparatus in which efficient heat transfer takes place at the combustion chamber outlet and downstream of the outlet.

Still another object of the present invention is to provide a swirl combustion apparatus with a high turndown ratio in which a high degree of heat transfer is achieved so that combustion temperatures can be reduced in order to produce exhaust gases having low carbon monoxide and $NO_x$ levels.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

To achieve the foregoing objects, and in accordance with the invention as embodied and broadly described herein, there is provided a swirl combustion apparatus, comprising: a combustion chamber having a front end, a rear end and a longitudinally extending substantially cylindrical wall having an inner surface; means for supplying a peripheral swirl of air into the combustion chamber adjacent the inner surface of the cylindrical combustion chamber wall; means for supplying fuel into the combustion chamber for mixing with the swirl of air and burning in the combustion chamber to form swirling hot combustion gases in the combustion chamber; and means for directing the swirling hot combustion gases out of the combustion chamber in a direction substantially tangential to the inner surface of the cylindrical combustion chamber wall.

In a specific form of the invention, it is preferable to provide precombustion chamber means for maintaining self-sustained combustion from a mixture of fuel and air in a precombustion chamber and for supplying partially pre-burned fuel into the combustion chamber for mixing with the swirl of air and burning in the combustion chamber to form swirling hot combustion gases in the combustion chamber. It is also preferable that the combustion chamber gas directing means includes a combustion chamber rear end wall having an annular combustion chamber outlet for directing the swirling hot combustion gases out of the combustion chamber. It is also preferable to provide heat exchange means surrounding and extending substantially throughout the axially length of the combustion chamber for cooling the wall of the combustion chamber.

BRIEF DESCRIPTION OF THE DRAWINGS

The accompanying drawings, which are incorporated in and constitute a part of the specification, illustrate preferred embodiments of the invention and, together with the general description given above and the detailed description of the preferred embodiments given below, serve to explain the principles of the invention.

FIG. 6(*a*) is a fragmentary, partly broken away side elevational view of the front end of the boiler shown in FIG. 3;

FIG. 6(*b*) is a fragmentary view in perspective of the front end of the boiler illustrated in FIG. 6(a);

FIG. 6(*c*) is a cross-sectional view taken along the line C—C of FIG. 6(*a*);

FIG. 7(*a*) is a side elevational view of the combustion chamber outlet end of the boiler shown in FIG. 3;

FIG. 7(*b*) is a fragmentary view in perspective of the outlet end shown in FIG. 7(*a*);

FIG. 7(*c*) is a cross-sectional view taken along the line C—C in FIG. 7(*a*);

DESCRIPTION OF THE PREFERRED EMBODIMENT

Figure 1:
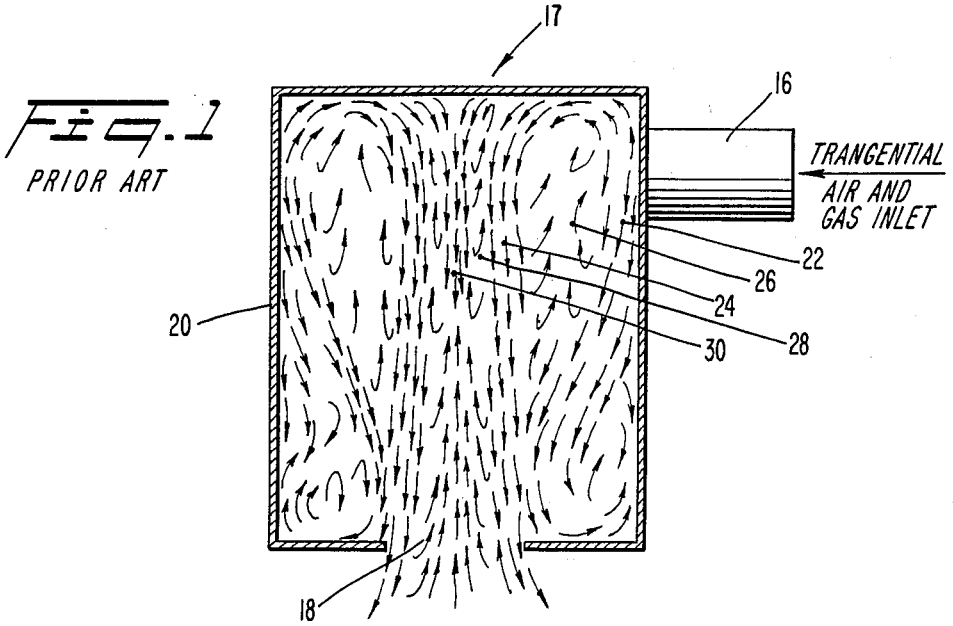
FIG. 1 PRIOR ART
FIG. 1 is a side elevation in cross-section of a cyclone combustion chamber according to the prior art.
Figure 2:
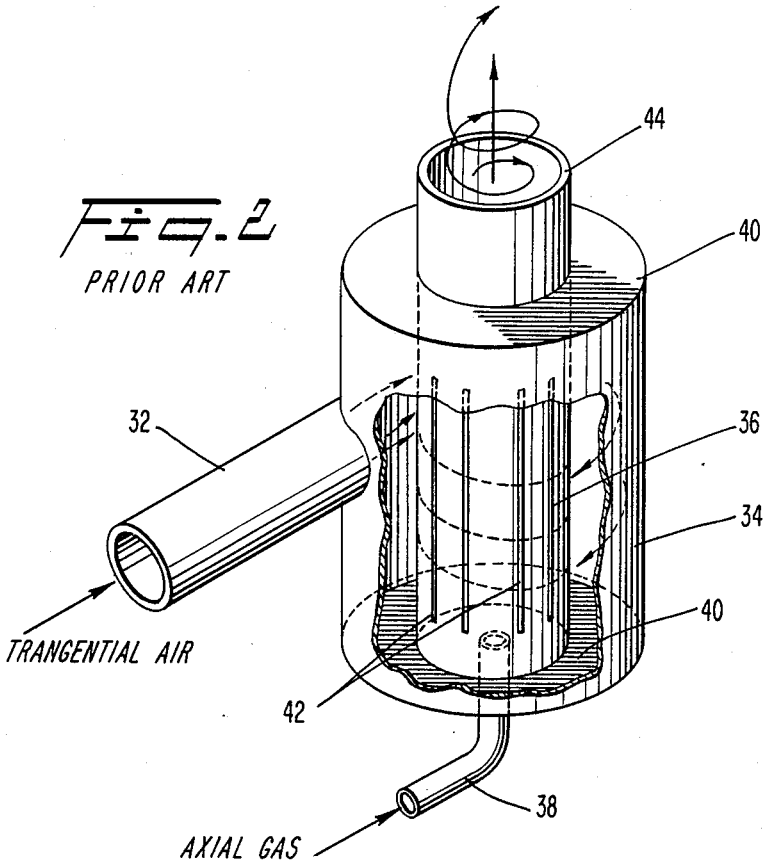
FIG. 2 PRIOR ART
FIG. 2 is a perspective cut away view of a swirl burner according to the prior art.

Reference will now be made in detail to the present preferred embodiments of the invention as illustrated in the accompanying drawings. Like reference characters are used to designate like elements in some of the drawings.

In accordance with the invention, there is provided a swirl combustion apparatus comprising a combustion chamber having a front end, a rear end and a substantially cylindrical wall having an inner surface.

Figure 3:
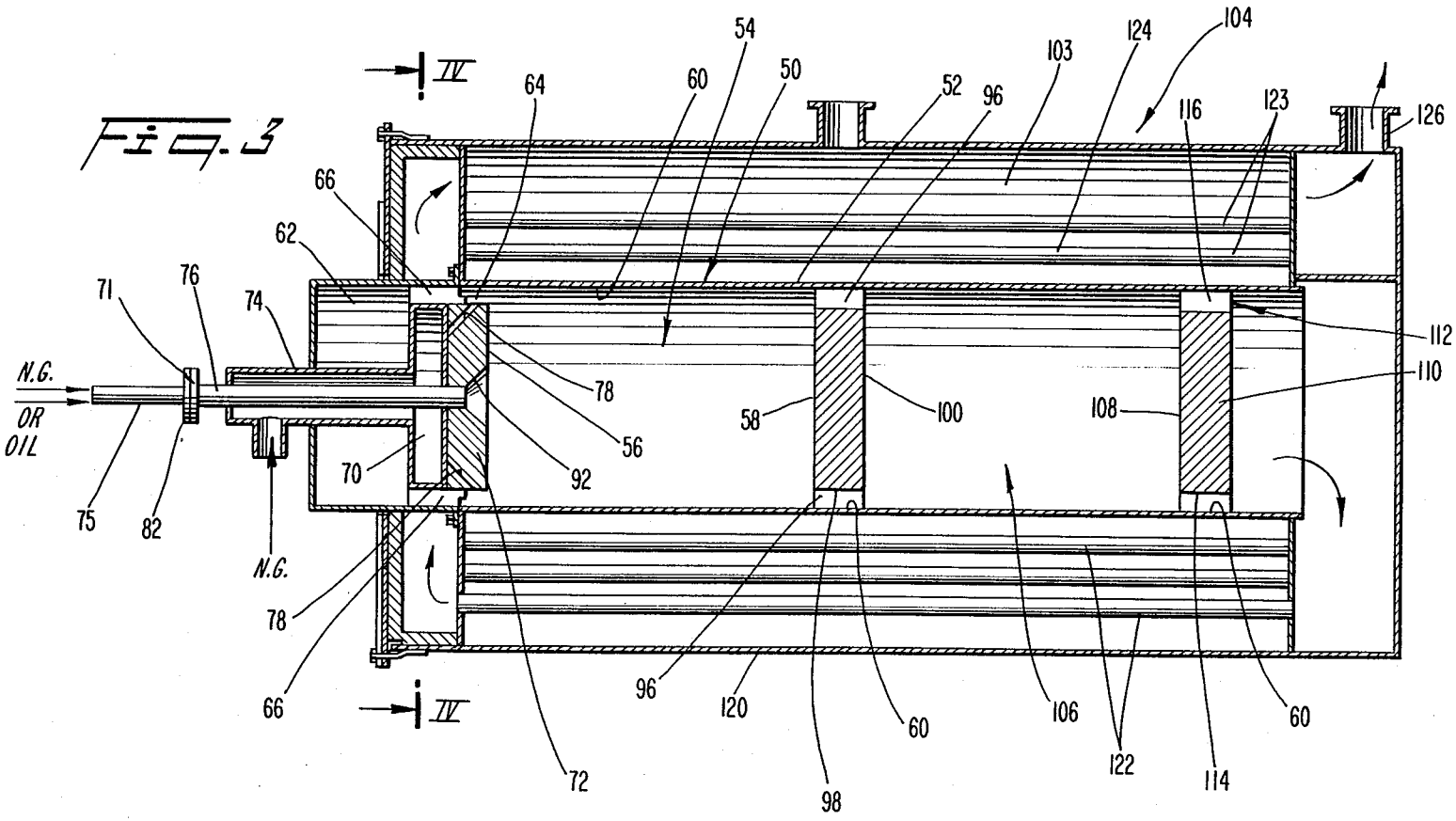
FIG. 3 is a side elevation in cross-section of a first embodiment of a boiler incorporating the teachings of the present invention.

FIG. 3 shows a horizontally disposed fire tube boiler having a swirl combustion apparatus in accordance with one preferred embodiment of the invention. As embodied herein, a swirl combustion apparatus 50 includes a central fire tube 52 known as a Morison tube defining a combustion chamber 54. Chamber 54 includes a front end 56 and a rear end 58 and a portion of the central tube 52, which forms a substantially cylindrical longitundinally extending outer wall having an inner surface 60 facing into chamber 54.

The invention includes means for supplying a peripheral swirl of air adjacent the inner surface of the combustion chamber directly into the combustion chamber from the front end thereof. As embodied herein, such means includes an air plenum chamber 62, an annular air supply opening 64 and a plurality of spaced radial vanes 66. Air plenum chamber 62 is coaxially fixed on front end 56 of combustion chamber 54. Air plenum chamber 62 has an air inlet 63 (FIG. 5) which injects air into plenum chamber 62 and which is preferably tangentially aligned with plenum chamber 62 in order to facilitate the entrance of air into plenum chamber 62 with a minimal air pressure drop.

Plenum 62 communicates with annular air supply opening 64 and is axially aligned with combustion chamber 54, as shown in FIGS. 6(*a*)–(*c*). Annular air supply opening 64 has an outer diameter that is substantially equal to the diameter of the inner surface 60 of tube 52 of combustion chamber 14. As shown in FIG. 6(*a*), opening 64 includes a first annular segment 68 having an inner wall defined by a circumferential wall of a gas distribution plenum chamber 70 and having an outer wall defined by a portion of a wall 71 of plenum chamber 62. Opening 64 further includes a second annular segment 69 having an inner wall defined by an outer circumferential surface of an end plate at front end 56 of chamber 54 and having an outer wall defined by inner surface 60 of a portion of cylindrical wall 52 of chamber 54. The diameters of the inner and outer walls of first annular segment 68 are substantially equal to the respective inner and outer walls of annular segment 69.

A plurality of spaced radial vanes 66 are provided in first segment 68 of annular air supply opening 64. Radial vanes 66 are tilted at a selected angle ($\theta$) from the normal axis of combustion chamber 54, as is best shown in FIG. 6(*c*). Decreasing the selected angle ($\theta$) between vanes 66 and the normal axis of combustion chamber 54 has the effect of increasing the angular velocity, at a given combustion chamber cross-sectional area and air flow, of air entering combustion chamber 54 through annular air supply opening 64. Angle ($\theta$) is preferably in the range of about 20° to about 30°. Air entering combustion chamber 54 has a swirling flow pattern due to the selected angle ($\theta$) of vanes 56 which generates air swirling in combustion chamber 54.

According to the present invention, there is provided means for supplying fuel into the combustion chamber. As embodied herein and referring to in FIGS. 6(*a*)-(*c*), such means includes a first fuel inlet pipe 76 passing through air plenum chamber 62, through gas distribution plenum chamber 70 and through an end plate 72. The supplied fuel burns in the presence of the supplied air in the combustion chamber 54 to form hot combustion gases.

According to one preferred embodiment of the invention, there is provided means for injecting a gaseous fuel immediately adjacent the annular air supply opening. As embodied herein in FIGS. 6(*a*)-(*c*), such means include a gas inlet pipe 74 surrounding fuel pipe 76, gas distribution plenum chamber 70 and a plurality of spaced gas nozzles 78. Gas distribution plenum chamber 70 is defined by front end 56 of combustion chamber 54 between combustion chamber 54 and air plenum chamber 62. Combustible gas is supplied to gas distribution plenum chamber 70 through annular space 80 between gas inlet pipe 74 and fuel pipe 76.

Gas nozzles 78 communicate gas distribution plenum chamber 70 with annular air supply opening 64. Gas nozzles 78 extend through a radial wall of end plate 72 that is positioned between combustion chamber 50 and gas distribution plenum chamber 70 and is preferably comprised of refractory material. Spaced nozzles 78, as shown in FIGS. 6(*a*)-(*c*), have outlets for discharging gas around the complete outer circumference of end plate 72.

Figures 7A, 7B, 7C, 8:
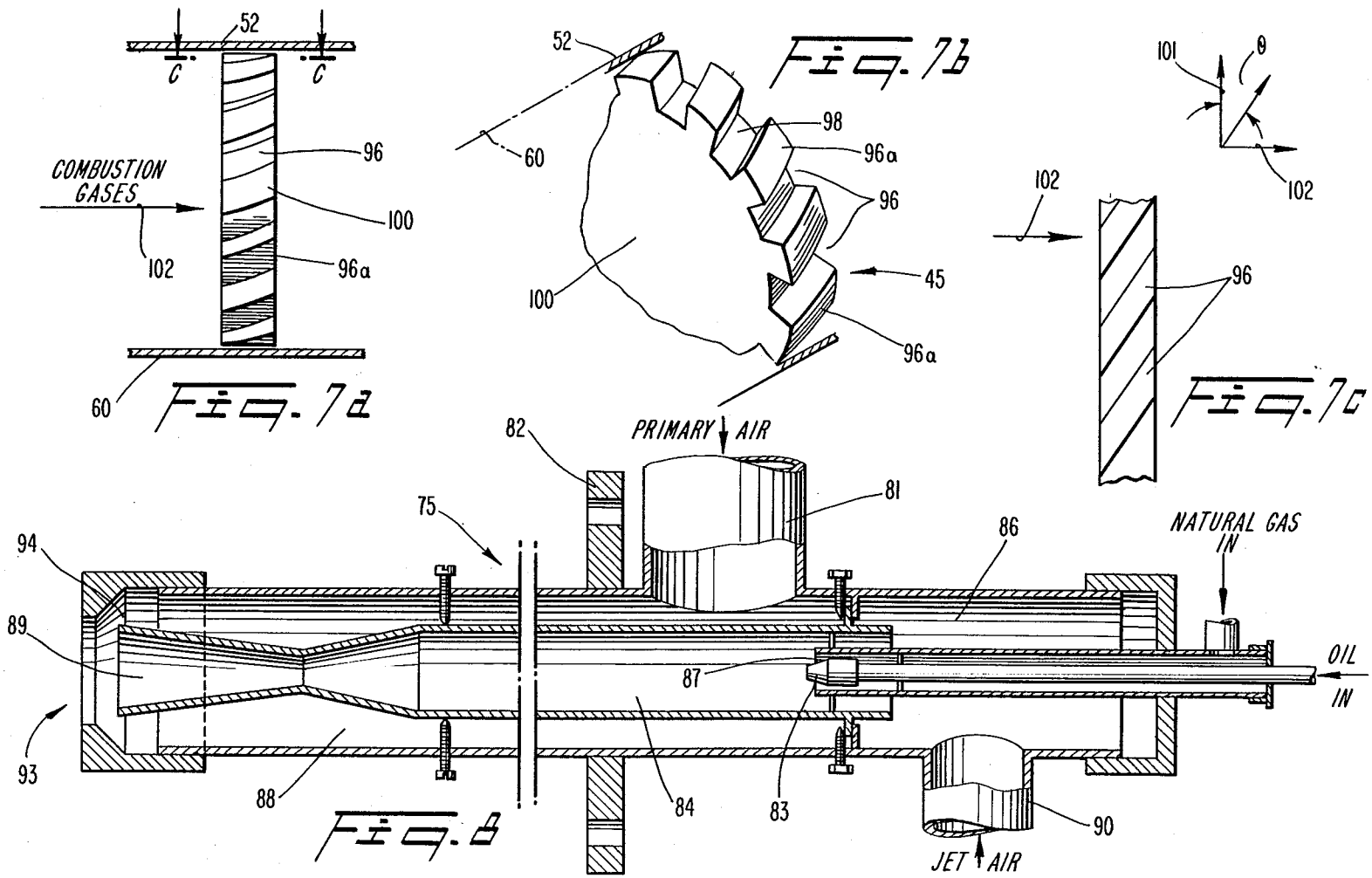
FIG. 8 is an enlarged side elevation view in cross-section of a jet burner/vaporizer in inlet pipe of FIG. 3.

As shown in FIG. 3, a self-sustained pre-combustion burner such as jet burner 75 is used to supply partially combusted fuel through fuel inlet pipe 76 to combustion chamber 54. Fuel inlet pipe 76 includes a first flange 71, and jet burner 75 includes a flange 82 connected to flange 71. Jet burner 75 is in communication with front end 56 of combustion chamber 54. As shown in FIG. 8, jet burner 75 includes a precombustion chamber 84, a jet air chamber 86 and an annular primary air chamber 88. Fuel oil enters precombustion chamber 84 through a fuel nozzle 83 when liquid fuel is burned. When natural or other gas is burned, the fuel enters precombustion chamber 84 through an annular space 87 around nozzle 83. Upon entering precombustion chamber 84, the fuel burns with jet air (also referred to as pre-burning air) which is supplied from jet air chamber 86 through a jet air supply inlet 90. The jet air supply and fuel supply are controlled to achieve a desired air-fuel mixture in the precombustion chamber 84. Primary air is supplied through a primary air supply inlet 81 into annular air chamber 88 which annularly surrounds precombustion chamber 84. Precombustion chamber 84 is heated by partial burning of the fuel. The outside surfaces of precombustion chamber 84 are cooled by primary air passing through annular air chamber 88.

The partially preburned fuel enters combustion chamber 54 through an outlet 89 of precombustion chamber 84 in end 93 of jet burner 75. An annular air chamber outlet 94 discharges the heated primary air stream in a flow pattern surrounding the partially burned fuel entering combustion chamber 54 from precombustion chamber 84. Annular air chamber outlet 94 and precombustion chamber outlet 89 connect with beveled portion 92 in end plate 72 (FIG. 3). The partially preburned fuel from precombustion chamber 84 undergoes further burning when it comes in contact with the primary air supply introduced through inlet 81.

Jet burner 75 provides a stable self-sustained combustion flame for combustion chamber 54 over a wide range of operating loads. Jet burner 75 is disclosed in detail in U.S. patent application Ser. No. 044,733 filed May 1, 1987 to Korenberg, which is incorporated by reference herein for a more detailed description thereof. Alternatively, other self-sustaining precombustion burners can be used in place of jet burner 75.

According to the invention, there is means for directing the swirling hot combustion gases out of the combustion chamber in a direction substantially tangential to the inner surface of the combustion chamber walls. In a specific case it is preferred that a combustion chamber rear end wall at the rear end of the combustion chamber is provided. The combustion chamber rear end wall has an annular combustion chamber outlet therein, the annular combustion chamber outlet being concentrically aligned with the combustion chamber and defined by an outer cylindrical outlet wall and an inner cylindrical outlet wall. The annular combustion chamber outlet has gas directing means for directing hot combustion gases through the annular combustion chamber outlet in a direction substantially tangential to the inner surface of the combustion chamber wall.

As embodied herein, and shown in FIGS. 7(a)-(c), such gas directing means includes a plurality of angularly spaced radial outlet slots 96 defined by slot divider portions 96a integrally formed in a rear end wall 100 of combustion chamber 54. The slots 96 of which constitute combustion chamber outlet extend between an outer radial position defined by inner surface 60 of tube 52 and an inner radial position defined by cylindrical outlet wall 98 of rear end wall 100.

Inner surface 60 of wall 52 which defines the outer cylindrical wall of slots 96 forms a smooth continuous surface which enhances swirling of hot combustion gases. Preferably, rear end wall 100 that forms outlet slots 96 is comprised of a refractory material. As shown in FIG. 7(*c*), each of the plurality of slots 96 is tilted from an axis represented by arrow 101 normal to the longitudinal axis of the combustion chamber 54 represented by arrows 102 by an angle ($\theta$) in the range of about 15° to about 35°. The plurality of tilted outlet slots 96 enhance swirling along the inner surface 60 of tube 52 of combustion chamber 54. Slots 96 also encourage additional swirling downstream of angular spaced slots 96 constituting the annular outlet of the combustion chamber 54.

In one specific form, the invention includes heat exchange means surrounding and extending substantially throughout the axial length of the annular combustion chamber for cooling the outer cylindrical wall of the combustion chamber. As embodied herein, and as shown in FIG. 3, such heat exchange means includes a chamber 103 of a fire tube boiler 104 which is filled with a cooling fluid and which surrounds the Morison tube 52 including the portion thereof defining combustion chamber 54 and slots 96. Fire tube boiler 104 will be described in greater detail below.

According to one specific form of the invention, the swirl combustion apparatus further comprises a substantially cylindrical cooling chamber having a substantially cylindrical wall extending axially beyond the annular combustion chamber outlet in the rear end wall of the combustion chamber and substantially longitudinally aligned with the combustion chamber. As embodied herein, a cooling chamber 106 extends from front end 100 to rear end 108.

According to a preferred embodiment of the invention, heat exchange means are provided substantially coextensive with the axial length of the combustion chamber and the cooling chamber for substantially cooling the walls of the Morison tube. As embodied herein, such means include chamber 103 of fire tube boiler 104, which is filled with cooling fluid. The entire length of tube 52 absorbs heat from swirling combustion gases within combustion chamber 54, slots 96, and cooling chamber 106. Swirling gases moving tangentially along inner surface 60 of tube 52 are thus efficiently cooled by the heat exchange means.

The FIG. 3 embodiment can be used with or without an annular cooling chamber outlet. If an annular cooling chamber outlet is used, it is aligned substantially concentrically with the combustion chamber, the annular cooling chamber outlet defined by a cooling chamber outlet outer cylindrical outlet wall and a cooling chamber outlet inner cylindrical outlet wall, the annular cooling chamber outlet having gas directing means for directing combustion gases through the annular cooling chamber outlet in a direction substantially tangential to the inner surface of the cooling chamber cylindrical wall.

As embodied herein and as shown in FIG. 3, cooling chamber 106 has a rear end 108 with a cooling chamber rear end wall 110 formed therein. A cooling chamber annular outlet 112 is formed in wall 110 and is defined by inner surface 60 of tube 52 and an inner cylindrical outlet wall 114 of end wall 110. A plurality of cooling chamber outlet slots 116 are integrally formed in end wall 110 and disposed in annular outlet 112 in the same manner as the outlet slots shown in FIGS. 7(*a*)–7(*c*). Inner surface 60 of outer cylindrical wall 52 of annular cooling chamber outlet 112 form a smooth continuous surface which enhances swirling of cooling combustion gases along the inner surface of cooling chamber 106. Preferably, cooling chamber rear end wall 110 that forms slots 116 is comprised of a refractory material. Each of the plurality of cooling chamber outlet slots is tilted from an axis normal to the longitudinal axis of the combustion chamber by an angle in the range of about 15° to about 35°. The plurality of tilted cooling chamber outlet slots 116 are angled to enhance swirling along the inner surface 60 of wall 52 of cooling chamber 106.

It can be seen that chamber 106 acts as a cooling chamber regardless of whether wall 110 is used or not. Wall 110 is used in order to intensify cooling effect in chamber 106 and downstream. Wall 110 also is used for preventing the swirling flow from dying out in cooling chamber 106.

The heat exchange means surrounding and extending substantially throughout the axial length of the combustion chamber for cooling the wall of the combustion chamber and for absorbing heat from hot gases exhausted from the combustion chamber outlet comprises a portion of a fire tube boiler. The heat exchange means includes an outer shell surrounding the combustion chamber, a plurality of spaced gas tubes disposed between the outer shell and the combustion chamber for conducting hot gases from the combustion chamber, and a space within the shell exterior of the gas tubes and the outer surface of the combustion chamber for containing a cooling fluid.

Figure 4:
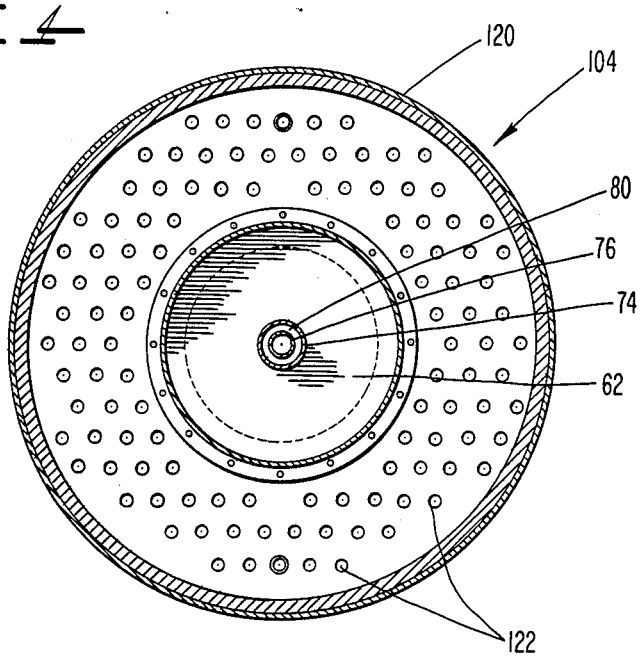
FIG. 4 is a cross-section view taken along the line IV—IV of FIG. 3.
Figure 5:
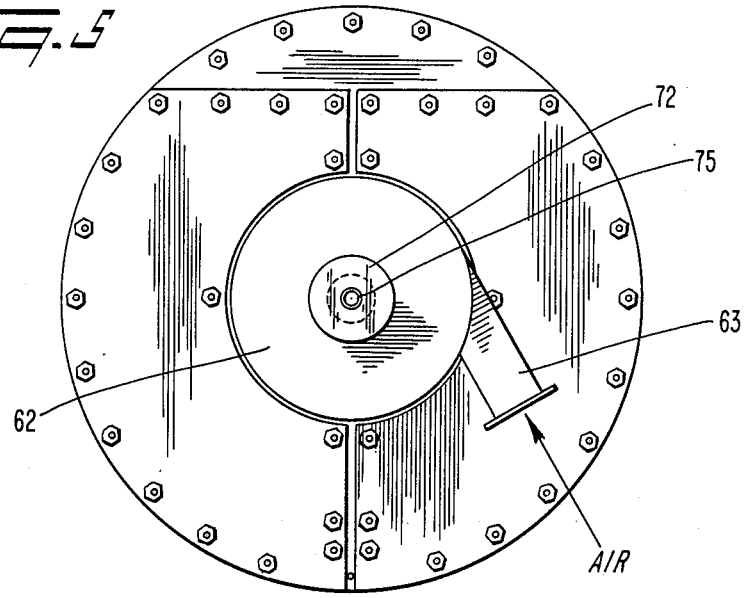
FIG. 5 is a front end view of the boiler illustrated in FIG. 3.

As embodied herein, such heat exchange means includes portions of the fire tube boiler shown in FIGS. 3–5. The fire tube boiler includes an outer boiler shell 120, a plurality of gas tubes 122 and 123 between outer shell 120 and Morison tube 52. A space 124 within shell 120, and exterior of gas tubes 122, 123 and Morison tube 52 is filled with cooling fluid, typically water. Cooling fluid in space 124 cools cylindrical outer wall 52 of combustion chamber 54 and cooling chamber 106.

First plurality of gas tubes 122 and second plurality of gas tubes 123 extend parallel to the axis of Morison tube 52. First plurality of gas tubes 122 are in communication at one end with an outlet 112 of cooling chamber 106 and at the opposite end with one end of second plurality of gas tubes 123 that are in turn in communication at their opposite ends with an exhaust flue 126 that exhausts gases from tubes 123. The arrows in FIG. 3 indicate the direction of gas flow, as is conventionally known for fire tube boilers.

The swirl combustion apparatus of the present invention may also be applied to boilers in which the Morison tube is surrounded by a water jacket (FIG. 9) or to water tube boilers having combustion gas exhaust tubes passing through the steam drum of the boiler. Such boilers are disclosed in U.S. patent application Ser. No. 044,735 filed May 1, 1987 by *Korenberg* which is incorporated herein by reference.

Figure 9:
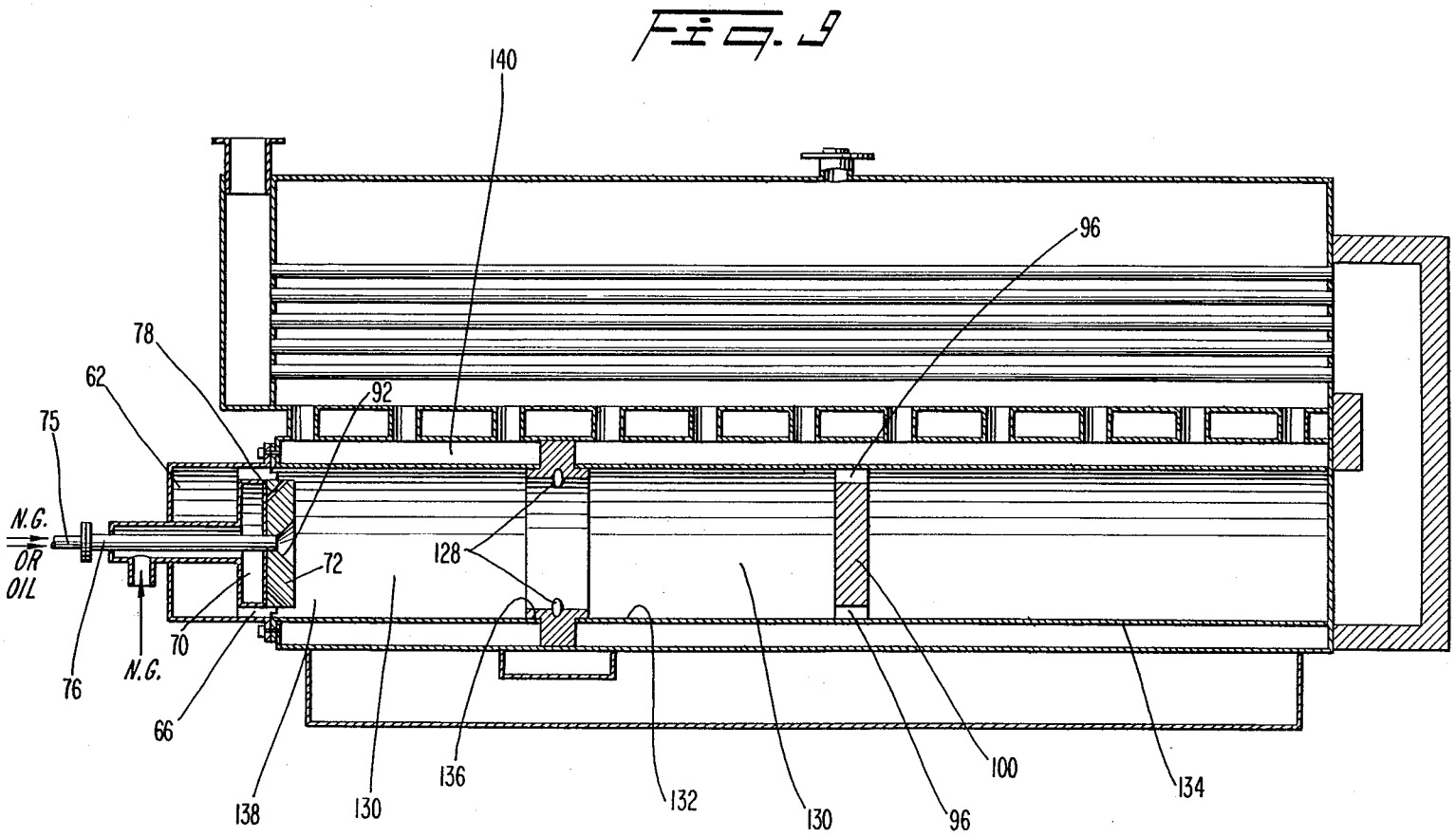
FIG. 9 is a side elevation view in cross-section of a second embodiment of a boiler incorporating the teachings of the present invention.

According to the embodiment of the invention shown in FIG. 9, tertiary air inlets 128 may be provided in combustion chamber 414. Tertiary air inlets 128 are tangentially aligned with the inner surface 132 of wall 134 of chamber 130 for providing additional cyclonic swirling action within cyclonic combustion chamber 130. As shown in FIG. 15, tertiary air inlets 128 are formed in a circumferential portion 136. Portion 136 is preferably formed of a refractory material.

Supplying tertiary air to combustion chamber 130 allows for greater control of combustion within combustion chamber 130. Further, because tertiary air inlets 128 are axially spaced from front end 138 of combustion chamber 130, excess air in the front end of combustion chamber 130 can be reduced because air for combustion in the rear end of chamber 130 is supplied by tertiary air inlets 128. With this arrangement primary, secondary and tertiary air supplies can be controlled relative to the fuel supply so that combustion in the front end of combustion chamber 130 takes place at substoichiometric conditions. Downstream of tertiary air inlets 128, combustion will be above stoichiometric combustion conditions. Thus, combustion in the front portion of combustion chamber 130 is substoichiometric and temperatures are reduced due to cooling of cylindrical wall 134 of combustion chamber 130 by heat exchanger 140 so that $NO_x$ production is kept low. This air staging technique may also be provided on other embodiments such as that shown in FIG. 10.

Figure 10:
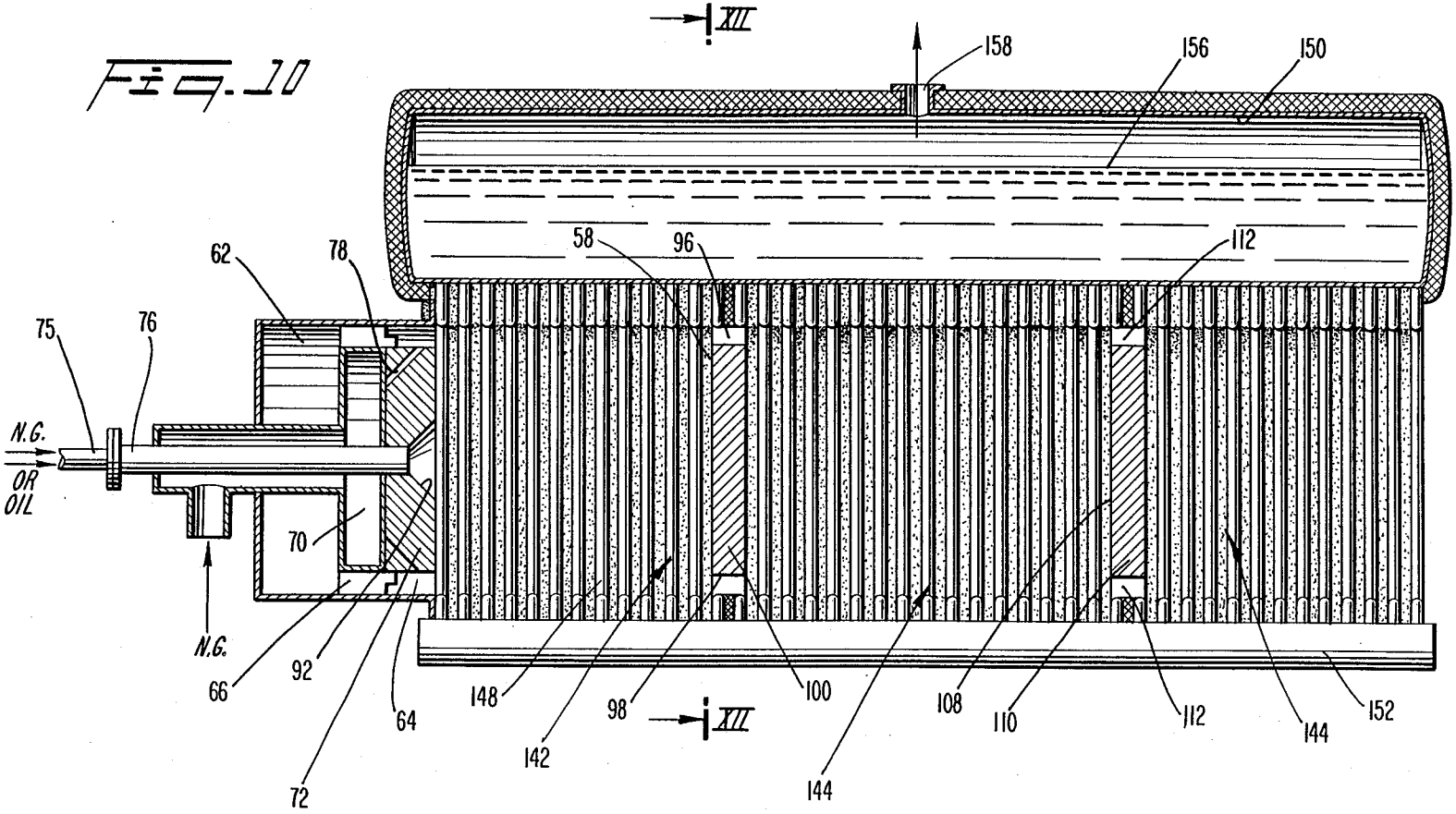
FIG. 10 is a side elevation view in cross-section of a third embodiment of a boiler incorporating the teachings of the present invention.
Figure 12:
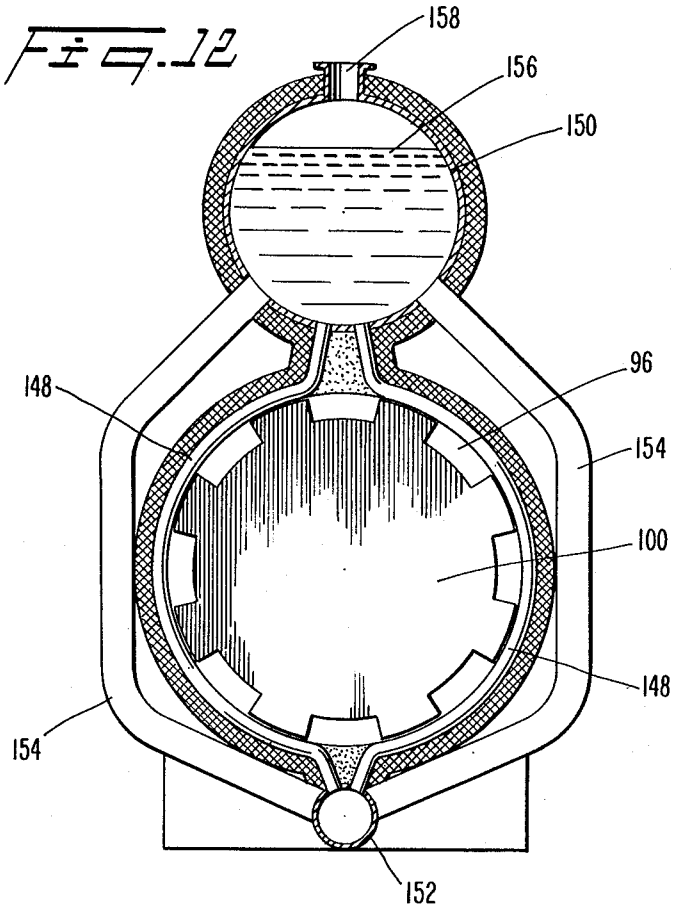
FIG. 12 is a cross-sectional view taken along the line XII—XII of FIG. 10.
Figure 11:
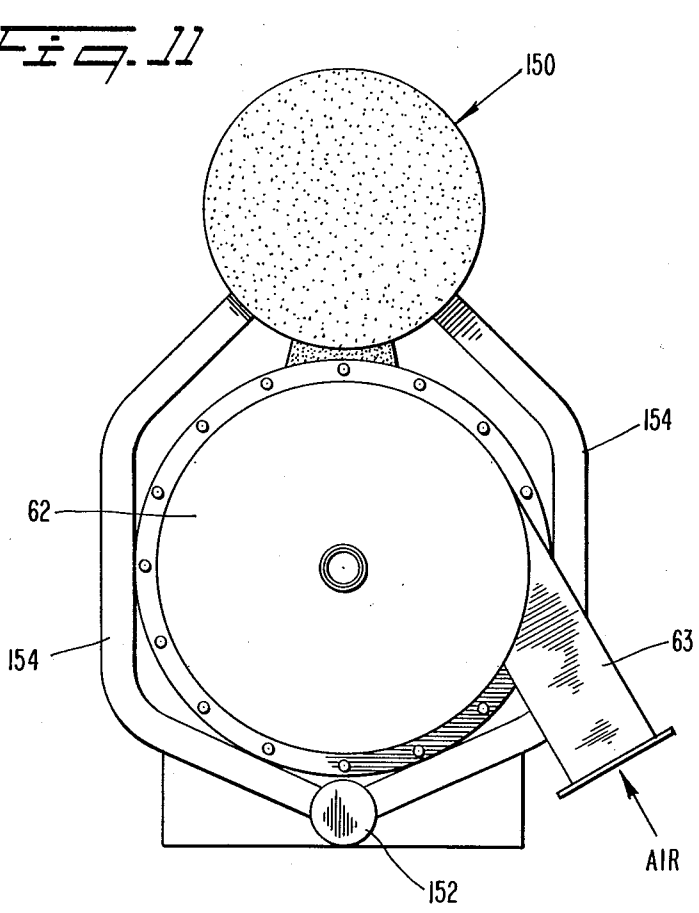
FIG. 11 is a front end view of the boiler illustrated in FIG. 10.

According to another embodiment of the invention the heat exchange means surrounding and extending substantially throughout the axial length of the combustion chamber for cooling the wall of the combustion chamber may include a portion of a water tube boiler as shown in FIGS. 10–12. The water tube boiler is useful in that it allows for combustion at pressure and boiler operating levels greater than can be achieved with fire tube boilers.

The water tube boiler shown in FIG. 10 includes a swirling combustion apparatus like the one described above having a combustion chamber 142 and a cooling chamber 144 extending from rear end of combustion chamber 142. As with the embodiment shown in FIG. 3, the apparatus can be used with or without an annular cooling chamber outlet such as partition 110 having tangential slots to intensify or maintain cooling effect from dying out in order to have high heat transfer to the chamber walls.

Combustion chamber 142 and cooling chamber 144 have walls formed from a plurality of cooling tubes 148 extending throughout the axial lengths of combustion chamber 142 and cooling chamber 144. Cooling tubes 148 may be either contiguously joined or spaced from and connected to each other by metal fins to form a continuous wall. Tubes 148 are connected between a steam drum 150, longitudinally extending parallel to and above combustion chamber 142 and cooling chamber 144, and a header 152, longitudinally extending parallel to and below combustion chamber 142 and cooling chamber 144. As shown in FIG. 12, steam drum 150 and header 152 are also connected by recirculation tubes 154 which recirculate cooling fluid from steam drum 150 to header 152.

In operation, cooling tubes 148 are filled with cooling fluid for absorbing heat from combustion chamber 142 and cooling chamber 144. When the cooling fluid absorbs heat, saturated steam is generated which rises into steam drum 150 above cooling fluid level 156. Steam is exhausted through passage 158.

The present invention can be seen to have a distinctive combustion gas outlet, when compared to conventional devices in which swirling flow is used to achieve high combustion intensity. Unlike conventional cyclone combustion chambers which have an axial orifice type gas outlet, the present swirl combustion chamber has tangential air inlets and gas outlets formed by vanes and guide slots or tangential nozzles through which the combustion gas is passed from the chamber.

Such tangential gas outlets from the combustion chamber have a crucial effect upon swirling gas flow inside the chamber. In comparison with conventional cyclone combustion chambers which have three or more swirling reverse flows, the present swirl combustion chamber has mainly one direct swirling flow. The velocity of that one direct swirling flow, if controlled properly by design, can be prevented from decaying or may even be increased at the chamber tangential outlet.

It is conceivable that some of the after-burning would occur in the vane type slots through which high temperature, high velocity combustion gases from the swirl combustion chamber passes through into a downstream cooling chamber. Each of these slots, being of a rectangular shape and cross-section, has three refractory walls and one water cooled wall which is part of the combustion chamber. In these chambers, due to the high gas velocity, a high heat transfer coefficient is provided and, therefore, a further gas temperature reduction along with the fuel after-burning can occur.

The high velocity of the combustion gases exiting from the swirl combustion chamber and the extremely high swirl number of the gases after passing through the swirl combustion chamber, provide a high heat transfer coefficient in the whole downstream cooling chamber. This high heat transfer coefficient significantly affects the overall boiler design. As a result, two cooling chambers installed in series, could provide a significant reduction of the combustion gas temperature.

The present swirl combustion chamber invention can be employed in a variety of apparatus as a single unit or as an integral part of the apparatus. Examples of apparatus in which the swirl combustion chamber invention can be employed include: (1) a separate swirl combustion chamber unit having one stage combustion, that blows into a furnace or other open volume; (2) a one stage swirl combustion chamber integral with a fire tube boiler or water tube boiler; (3) a two stage swirl combustion chamber which could be applied to fire and water tube boilers and having low $NO_x$ combustion with or without interim cooling between stages, a possibility of burning two different fuels in which one has a lower heating value; and (4) part of a cyclonic incinerator which can be used for dry or liquid ash mode of operation. The incinerator can alternatively be an uncooled refractory lined unit, or water or air cooled refractory lined.

Figure 13:
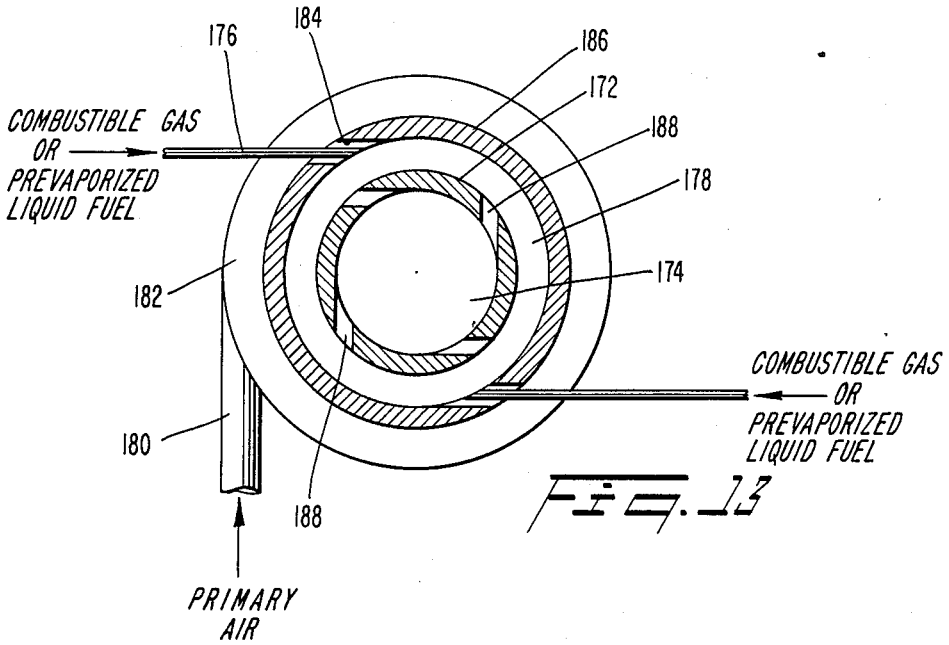
FIG. 13 is a top cross-sectional view illustrating a fourth embodiment, which is an incinerator incorporating teachings of the present invention.
Figure 14:
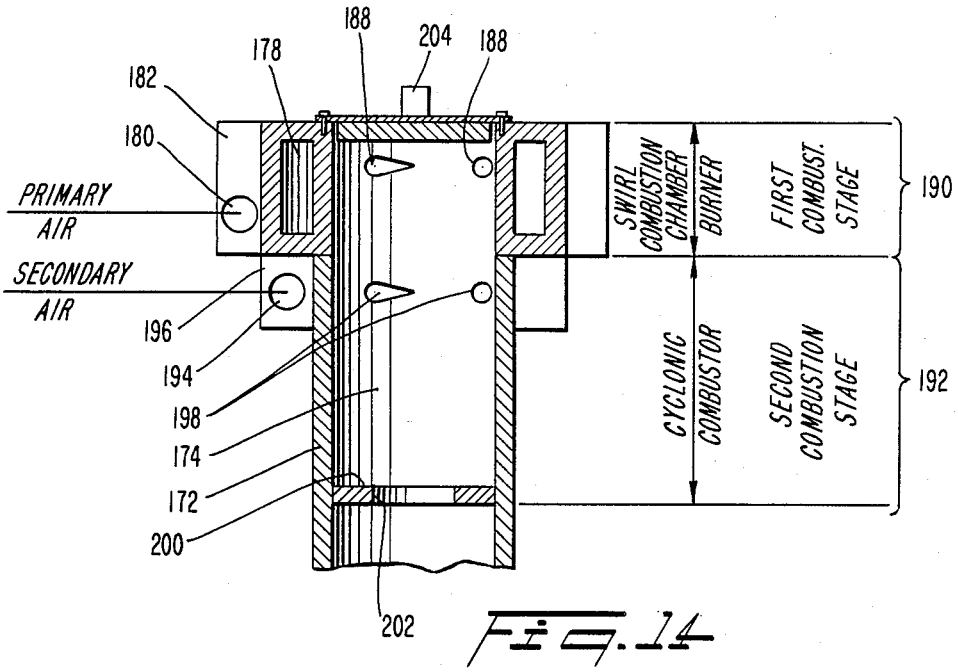
FIG. 14 is a side cross-sectional view of the incinerator illustrated in FIG. 13.

As shown in FIGS. 13 and 14, a swirl combustion chamber arrangement according to the present invention is used in a cyclonic furnace or incinerator. The incinerator chamber wall 172 surrounding incinerator chamber 174 can be either an uncooled refractory lined chamber or a refractory lined chamber which is cooled by air or water. Combustible gas or prevaporized liquid fuel is supplied through fuel supply pipe 176 to annular chamber 178 which surrounds incinerator chamber 174. Primary air is supplied through primary air pipe 180 to annular plenum 182, which surrounds annular chamber 178. Primary air procedes from annular plenum 182 to annular chamber 178 through annular passages 184 surrounding fuel pipe 176 as it passes through the cylindrical wall 186 which separates the interannular chamber 178 from the annular plenum 182. As a result, primary air and fuel are swirled together and burned in annular chamber 178 and fed into incinerator chamber 174 through tangential ports 188 in incinerator chamber wall 172 so that swirling afterburning (if any) occurs inside the top portion of chamber 174.

As best seen in FIG. 14, a first combustion stage is formed by the swirl combustion chamber burner area 190 in the upper portion of the incinerator in annular chamber 178. Axially downstream of swirl combustion chamber burner area 190, is a second combustion stage formed by a cyclonic combustor area 192. Secondary air is supplied to secondary air pipe 194 into annular chamber 196 which is axially downstream of the swirl combustion chamber. Secondary air is supplied through tangential openings 198 in wall 172 to form a cyclonic combustion area 192. An end plate 200 is formed with an axially orifice 202 which is concentric with chamber 172, and is positioned axially downstream of the secondary air ports 198 to form a cyclonic flow pattern in the second combustion stage of the incinerator. Liquid or gaseous waste can be injected from the top 204 of the cyclonic incinerator, or below the primary air level before the secondary air inlet 194 or along with the secondary air. The swirl combustion chamber tangential inlets and outlets can have the same or different radius on which they are located.

The following comparisons of swirling and pressure drop characteristics for a conventional cyclone combustion chamber and a swirl combustion apparatus according to the present invention illustrate the advantages of the present invention. For this comparison, swirl characteristics are generally quantified in terms of Swirl Number, S, where a higher Swirl Number is indicative of greater tangential swirling.

$$S = m \cdot \phi^2 \cdot \frac{K_t(\text{in})}{K_t(\text{out})} \cdot X \cdot \frac{h_t}{Y_t} \cdot \cos^2 \theta$$

where:

$$m = \frac{\text{Density of Inlet Air}}{\text{Density of Outlet Combustion Gas}}$$

$$\phi = \frac{\text{air required per unit fuel (Volumetric)}}{\text{combustion gas produced per unit fuel (Volumetric)}}$$

$K_{t(in)}$ = Temperature Constant For Inlet Flue Gases
$h_{t(out)}$ = Temperature Constant For Outlet Flue Gases $$X = \frac{\text{Outlet Opening Diameter}}{\text{Combustion Chamber Diameter}}$$

$$h_t = \frac{\text{Tangential Air or Combustion Gas Flow Rate}}{\text{Combustion Chamber Total Air of Combustion Gas Flow Rate}}$$

($h_t$ equal or less than 1 for swirl combustion chamber inlets; equal to 1 for swirl combustion chamber outlets)

$$y_t = \frac{\text{Tangential Opening Cross Sectional Area}}{\text{Normal to axis Chamber Sectional Area}}.$$

$\theta$ = Inclination Angle of Vanes or Slots

Pressure drop is quantified in terms of $\Delta P$ where:

$$\Delta P_{total} = \quad (\text{in}) \cdot \frac{W^2_{(in)} \cdot \rho_{(in)}}{2g\, K_{t(in)}} + Z\,(\text{out}) \cdot \frac{We\, \rho^2_{(out)}}{2g \cdot K_{t(out)}}$$

where:

$\xi$=Hydraulic Drag Coefficient
$W_{in}$=Velocity in Inlet Opening
$W_e$=Velocity in Exit Opening
$\rho_{(in)}$ =Inlet Opening Gas Density
$\rho_{(out)}$ =Outlet Opening Gas Density
g=Gravitational Constant
$K_{t(in)}$ and $K_{t(out)}$ =are Temperature Constants of the Inlet and Outlet Gases, respectively A comparison of calculated swirl numbers for a cyclone combustion chamber and a swirl combustion chamber show that the swirl number for a swirl combustion chamber is 35%–65% higher than the swirl number for a comparably dimensioned cyclone combustion chamber. This is indicative of significantly increased swirling in the swirl combustion chamber. When pressure drops are compared, it is seen that pressure drop for the swirl combustion chamber of the present invention is less than half the pressure drop of a comparably dimensioned combustion chamber.

When swirl numbers and pressure drops were calculated for a hypothetical 400 hp boiler with a cyclone combustion chamber, total pressure drop, $\Delta P_{total}$, was found to equal 11 inches of water column (W.C.) and Swirl Number, S was found to equal about 1.15. In a 400 hp boiler with a swirl combustion chamber having an approximately equal 11 inch W.C total pressure drop $\Delta P_{total}$, the swirl number of the gas outlet was found to be greater than 14. Thus, at the same pressure drop, the boiler with a swirl combustion chamber had a far higher Swirl Number than the boiler with the cyclone combustion chamber. This is indicative of substantially increased swirling and thus substantially increased heat transfer when a swirl combustion chamber is applied. In addition, at the same pressure drop, outlet gas velocity for the swirl combustion chamber was nearly double that of the comparable cyclone combustion chamber.

When a swirl combustion chamber and a cyclone combustion chamber having the same air inlet velocity and combustion gas outlet velocity were compared, it was found that the total pressure drop from the air inlet through the chamber outlet for the swirl combustion chamber was approximately half that of the cyclone combustion chamber. In addition, the Swirl Numbers after the chamber inlet and outlet were approximately 1.5 and eight times higher, respectively, for the swirl combustion chamber than the cyclone combustion chamber.

Because tangential velocity along the walls of the combustion chamber is significantly increased with the chamber of the present invention, heat transfer to chamber walls is increased. At a given specific heat release, combustion temperatures within the swirl combustion chamber of the present invention will be lower than the combustion temperature in a cyclone combustion chamber with the same given specific heat release. Thus, lower $NO_x$ emissions are produced by the swirl combustion chamber. In addition, because of increased swirling after the combustion chamber outlet in the present invention, heat transfer in a downstream cooling chamber is also increased which will improve overall boiler design.

It will be apparent to those skilled in the art that modifications and variations can be made in the swirl combustion apparatus of this invention. The invention in its broader aspects is, therefore, not limited to the specific details, representative apparatus, and illustrative examples shown and described above. Thus, it is intended that all matter contained in the foregoing description or shown in the accompanying drawings shall be interpreted as illustrative and not in a limiting sense.

What is claimed is:

1. A swirl combustion apparatus, comprising:

a combustion chamber having a front end, a rear end and a longitudinally extending substantially cylindrical wall having an inner surface;

means for supplying a peripheral swirl of air into the combustion chamber adjacent the inner surface of the cylindrical combustion chamber wall;

means for supplying fuel into the combustion chamber for mixing with the swirl of air and burning in the combustion chamber to form swirling hot combustion gases in the combustion chamber; and means for directing the swirling hot combustion gases out of the combustion chamber in a direction substantially tangential to the inner surface of the cylindrical combustion chamber wall, said directing means including a combustion chamber rear end wall having an annular combustion chamber outlet for directing the swirling hot combustion gases out of the combustion chamber, the annular combustion chamber outlet having an outer cylindrical outlet wall with a diameter substantially equal to the diameter of the inner surface of the cylindrical combustion chamber wall.

2. The swirl combustion apparatus of claim 1 wherein the gas directing means includes a plurality of spaced radial slots extending between the outer outlet wall and an inner outlet wall, the slots being tilted at a selected angle from the axis normal to the longitudinal axis of the combustion chamber.

3. The swirl combustion apparatus of claim 2 wherein the selected angle for each of the slots is substantially equal and is in the range of about 15° to about 35°.

4. The swirl combustion apparatus of claim 2 wherein the plurality of slots are defined by slot divider portions integral with the rear end wall.

5. The swirl combustion apparatus of claim 4 wherein the rear end wall with slot divider portions is composed of a refractory material.

6. The swirl combustion apparatus of claim 5 including heat exchange means surrounding the combustion chamber for cooling said combustion chamber.

7. The swirl combustion apparatus of claim 1 wherein the means for supplying a peripheral swirl of air includes a plurality of spaced radial vanes at the front end of the combustion chamber proximate to the cylindrical combustion chamber wall.

8. The swirl combustion apparatus of claim 2, wherein the means for supplying a peripheral swirl of air into said combustion chamber includes a plenum chamber on the front end of said combustion chamber having an annular air supply opening in communication with the front end of the combustion chamber.

9. The apparatus of claim 8 wherein the annular air supply opening has an outer diameter substantially equal to the diameter of the inner surface of the cylindrical combustion chamber wall.

10. The apparatus of claim 9 wherein the annular air supply opening includes a plurality of spaced radial vanes tilted at a selected angle from the axis normal to the longitudinal axis of said combustion chamber to effect substantially tangential air swirling in the combustion chamber.

11. The swirl combustion apparatus of claim 10 wherein the selected angle for each of the vanes is substantially equal and in the range of about 15° to about 35°.

12. The swirl combustion apparatus of claim 11 wherein the selected angle for each of the vanes in the annular air supply opening is substantially equal to the selected angle for each of the slots in said annular combustion chamber outlet.

13. The swirl combustion chamber of claim 8 wherein the plenum chamber has a tangential air inlet.

14. The swirl combustion apparatus of claim 13 including means for injecting gaseous fuel into the annular air supply opening.

15. The swirl combustion apparatus of claim 14 wherein the gaseous fuel injecting means includes a gas distribution plenum having a gas inlet pipe and a plurality of outlet nozzles communicating with the annular air supply opening.

16. The swirl combustion apparatus of claim 2 including a cooling chamber having a substantially cylindrical wall extending axially from the annular combustion chamber outlet and generally aligned with the cylindrical combustion chamber wall.

17. The swirl combustion apparatus of claim 16 including heat exchange means substantially coextensive with the length of the combustion chamber and the cooling chamber for substantially cooling the cylindrical walls of the combustion chamber and cooling chamber.

18. The swirl combustion apparatus of claim 17 wherein the cooling chamber includes means for directing combustion gases out of the cooling chamber in a direction substantially tangential to the cylindrical cooling chamber wall.

19. The swirl combustion apparatus of claim 18 wherein the cooling chamber gas directing means includes a cooling chamber rear wall having an annular cooling chamber outlet for directing the combustion gases out of the cooling chamber.

20. The swirl combustion apparatus of claim 18 wherein the cooling chamber outlet gas directing means includes a plurality of spaced radial slots extending between the cooling chamber outer cylindrical wall and an inner cylindrical wall, the slots being tilted at a selected angle from the axis normal to the longitudinal axis of the cooling and combustion chamber.

21. The swirl combustion apparatus of claim 20 wherein the selected angle for each of the slots in said cooling chamber outlet is substantially equal and is in the range of about 15° to about 35°.

22. A water tube boiler comprising:

a combustion chamber having a front end, a rear end and a longitudinally extending substantially cylindrical wall having an inner surface;

means for supplying a peripheral swirl of air into the combustion chamber adjacent the inner surface of the cylindrical combustion chamber wall;

means for supplying fuel into the combustion chamber for mixing with the swirl of air and burning in the combustion chamber to form swirling hot combustion gases in the combustion chamber;

means for directing the swirling hot combustion gases out of the combustion chamber outlet in a direction substantially tangential to the inner surface of the cylindrical combustion chamber wall, said directing means including a combustion chamber rear end wall having an annular combustion chamber outlet for directing the swirling hot combustion gases out of the combustion chamber, said annular combustion chamber outlet having an inner outlet wall, an outer outlet wall having a diameter substantially equal to the diameter of the cylindrical wall of the combustion chamber, and a plurality of spaced radial slots extending between said inner and outer outlet walls, said slots being tilted at a selected angle from the axis normal to the longitudinal axis of the combustion chamber; and heat exchange means surrounding and extending substantially along the length of said combustion chamber for cooling the wall of the combustion chamber, the heat exchange means including a steam drum longitudinally extending parallel to and above said combustion chamber, a header longitudinally extending parallel to and below said combustion chamber, a plurality of tubes connecting said header and steam drum, said tubes being integral with said combustion chamber wall along the length of said combustion chamber on opposite sides of said chamber for circulating cooling fluid which absorbs heat from said chamber and produces steam that is exhausted from said steam drum.

23. The apparatus of claim 22 including a cooling chamber having a substantially cylindrical wall extending axially from the annular combustion chamber outlet and generally aligned with the cylindrical combustion chamber wall.

24. The apparatus of claim 23 wherein the heat exchange means extends throughout the axial length of said combustion chamber and said cooling chamber, said tubes being integral with said combustion chamber wall and said cooling chamber wall for absorbing heat from said combustion chamber and cooling chamber.

25. The apparatus of claim 24 wherein the cooling chamber includes a cooling chamber rear wall having annular cooling chamber outlet with gas directing means for directing combustion gases from the annular cooling chamber outlet in a direction substantially tangential to the cylindrical cooling chamber wall.

26. The swirl combustion apparatus of claim 1 including a tangential air inlet in the wall of the combustion chamber between the front and rear ends of the combustion chamber for supplying tertiary air to the combustion chamber.

27. The swirl combustion apparatus of claim 22 including a tangential air inlet in the wall of the combustion chamber between the front and rear ends of the combustion chamber for supplying tertiary air to the combustion chamber.

* * * * *